United States Patent [19]

Tonokura

[11] Patent Number: 4,863,170

[45] Date of Patent: Sep. 5, 1989

[54] BOARD GAME HAVING MULTIPLE PLAYING SURFACES

[75] Inventor: Masayuki Tonokura, Tokyo, Japan

[73] Assignee: Tomy Kogyo Co., Inc., Tokyo, Japan

[21] Appl. No.: 232,010

[22] Filed: Aug. 15, 1988

[30] Foreign Application Priority Data

Nov. 16, 1987 [JP] Japan ..... 62-174584[U]

[51] Int. Cl.[4] ..... A63F 7/02

[52] U.S. Cl. ..... 273/126 R

[58] Field of Search ..... 273/126 R, 126 A, 121 R, 273/121 B, 122 R, 309

[56] References Cited

U.S. PATENT DOCUMENTS

| | | | |
|---|---|---|---|
| 3,462,149 | 8/1969 | Grusin | 273/126 R X |
| 3,797,828 | 3/1974 | Ishikawa et al. | 273/126 R |
| 3,825,265 | 7/1974 | Pitkanen et al. | 273/126 R |
| 3,857,564 | 12/1974 | Goldfarb et al. | 273/126 R X |
| 4,552,362 | 11/1985 | Oake | 273/309 X |

FOREIGN PATENT DOCUMENTS 55-286 7/1980 Japan .

*Primary Examiner*—William H. Grieb

*Attorney, Agent, or Firm*—Staas & Halsey

[57] ABSTRACT

A board game has a polyhedron-shaped member which includes a plurality of non-coplanar playing surfaces. A transparent plate covers each playing surface and at least one playing piece is moveable between the playing surfaces and the transparent plates. An inlet and an outlet is associated with each playing surface, and the inlets and outlets of the various playing surfaces are interconnected by a passage. An actuator associated with each playing surface propels the playing piece or playing pieces towards the outlet of each corresponding playing surface. Once passing through the outlet, the playing pieces are directed by the passage to the inlet of the next adjacent playing surface.

15 Claims, 3 Drawing Sheets

BOARD GAME HAVING MULTIPLE PLAYING SURFACES

BACKGROUND OF THE INVENTION

1. Field of the Invention

The present invention relates generally to board games, and more specifically, to a board game having multiple non-planar playing surfaces on which playing pieces are advanced sequentially from one playing surface to the next.

2. Description of the Related Art

A ball-sending game as disclosed in Japanese Utility Model Publication No. 55-286 has a concave groove-formed ball passage, a ball-sending member, and obstacles located on both surfaces of a board. A connecting hole facilitates passage of a ball through both faces of the board. The object of the connecting hole is to expand the area of the board face or playing surface, and thus, to provide games which can be played for a longer time.

The game disclosed in the above-mentioned Japanese publication has only a single type of game and thus can become monotonous to play.

SUMMARY OF THE INVENTION

An object of the present invention is to provide a board game which avoids monotonous play by providing multiple playing surfaces.

Another object of the invention is to provide a board game that is relatively inexpensive to produce.

Another object of the invention is to provide a board game which has multiple playing surfaces, each having a different playing mechanism.

In a preferred embodiment of the invention, a board game has a polyhedron-shaped member having a plurality of non-coplanar playing surfaces, a transparent plate covering each playing surface, at least one playing piece moveable between the playing surfaces and the transparent plates, an inlet and an outlet associated with each playing surface, with the inlet of one playing surface being in communication with the outlet of an adjacent playing surface, and actuator means associated with each playing surface for propelling the at least one playing piece towards the outlet of each corresponding playing surface.

These and other objects, together with other objects and advantages which will be subsequently apparent reside in the details of construction and operation of the board game as more fully hereinafter described and claimed, reference being had to the accompanying drawings forming a portion hereof, wherein like reference numerals refer to like portions throughout.

DETAILED DESCRIPTION OF THE DRAWINGS

Figure 1:
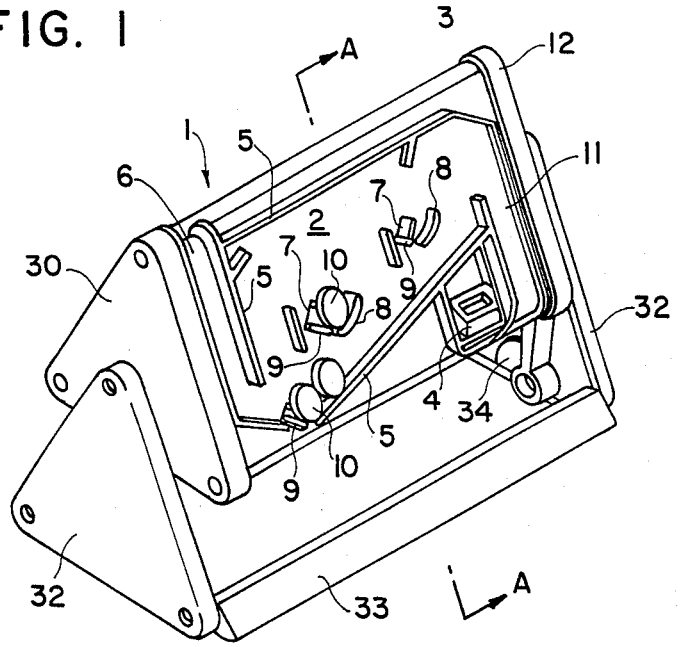
FIG. 1 is a perspective view showing a board game having multiple playing surfaces according to the present invention.

Referring to FIG. 1, a board game has a polyhedron-shaped member 1 whose outer surface provides a plurality of playing surfaces 2. In the embodiment illustrated in the drawings, three such playing surfaces 2 are disposed in a three-sided trihedron. Each playing surface 2 is covered by a transparent plate 3 which is spaced above the playing surface to allow playing pieces to move therebetween. Triangular side plates 30 are provided on opposite ends of the polyhedron-shaped member 1 (referred to hereinafter as "trihedron"). The triangular side plates 30 are attached by any conventional means, such as threaded fasteners.

Figure 2:
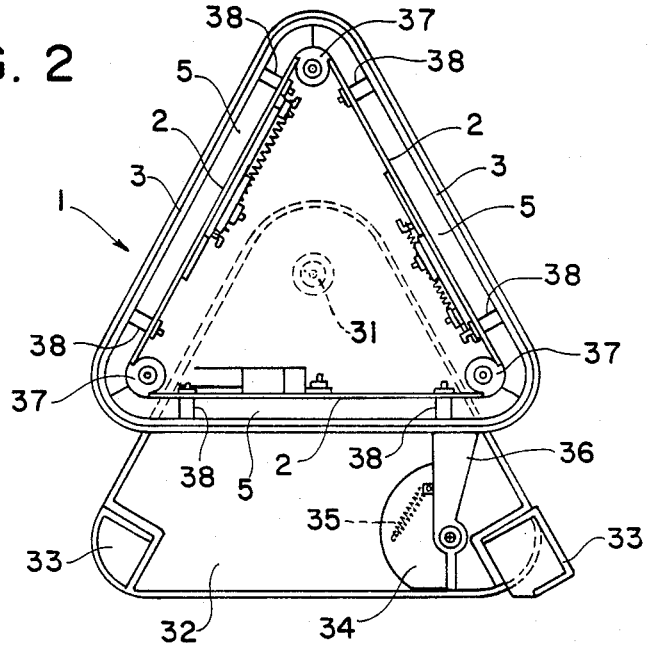
FIG. 2 is a cross-sectional view taken along line A—A of FIG. 1.

As shown in FIG. 2, spacers 38 maintain a predetermined distance between the playing surfaces 2 and the transparent plates 3. The spacers 38 support the playing surfaces 2 on distal end portions thereof. Three struts 37 are disposed at each vertex of the trihedron 1 and extend longitudinally between the two side plates 30. The opposite ends of each strut 37 are connected to the triangular side plates 30 by means of conventional fasteners, such as screws passing through the triangular side plates 30 into threaded bores provided in the struts 37.

A shaft 31 extends between the side plates 30 and rotatably supports the trihedron 1 between two vertical support plates 32 disposed outwardly of the side plates 30. The vertical support plates 32 are triangular in shape and are interconnected at bases thereof through links 33. The shaft 31 is journalled at its opposite ends in the apex of the vertical support plates 32. The shaft 31, the vertical support plates 32, and the links 33 form a stand for supporting and rotating the trihedron 1.

A hollow projection 34 is pivotally mounted at a lower portion of one of the two vertical support plates 32. A tension spring 35 is disposed within the hollow projection 34 in order to bias the hollow projection 34 into a vertically upright position as illustrated in FIG. 2. One end of the spring 35 is attached to an inner surface of the vertical support plate 32, while the other end is connected to the hollow projection 34 near a stopper portion 36 thereof. The upper end face of the stopper portion 36 provides an abutment which engages one of the sides of the trihedron 1, preferably at a horizontal surface of the side plate 30, to prohibit clockwise rotation of the trihedron as illustrated in FIG. 2, while at the same time allowing counterclockwise rotation thereof. In counterclockwise rotation, the stopper 36 is pushed forwardly by an apex portion of the trihedron 1 so that the next following playing surface is positioned for play in front of a player. Elements 34, 35 and 36 constitute a stopping mechanism which prohibits rotational movement of the trihedron 1 in one direction and allows rotational movement in the opposite direction.

It is possible to play the board game without the stand (shaft 31, vertical support plates 32 and links 33). However, the stand provides a convenient means for turning the board game to position each playing surface in front of the player.

The assembled structure of the transparent plates and the playing surfaces 2 is illustrated in FIG. 2. The playing surfaces 2 are connected to the upper portions of the spacers 38 upstanding from an inner surface of the transparent plates 3, which also have partition plates 5 upstanding therefrom in predetermined patterns.

Figure 3:
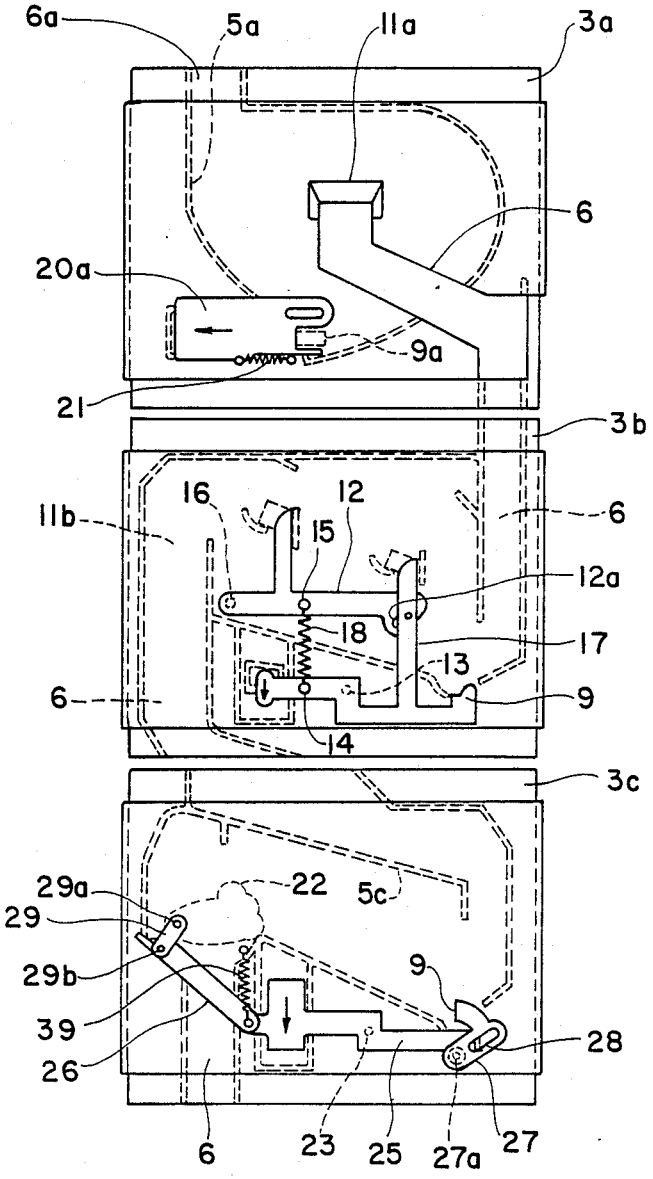
FIG. 3 is a bottom plan view of the playing surfaces of the board game according to FIG. 1.
Figure 4:
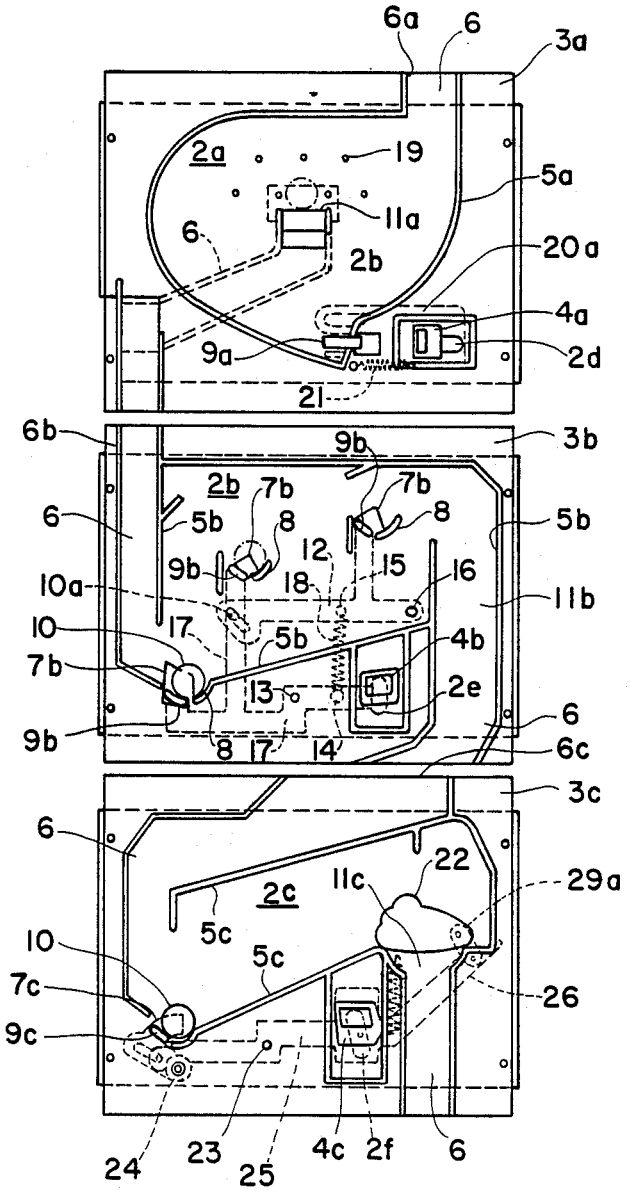
FIG. 4 is a top plan view of the playing surfaces of the board game according to FIG. 1.

FIG. 4 is a two-dimensional view of the three playing surfaces of the trihedron 1, which are referred to as the top, middle, and bottom playing surfaces 2*a*, 2*b*, and 2*c*, respectively. FIG. 3 illustrates the reverse-side of the playing surfaces.

In the upper portion of FIG. 4, a board game playing surface 2*a* includes a substantially elliptically shaped partition plate 5a and a plurality of pins 19 which are also upstanding from an inner surface of the transparent plate 3*a*. The pins 19 positionally correspond to an upper center of the board game playing surface 2*a*. An outlet 11 provides a "safe hole" which is open at the top thereof below the lower-most row of pins 19.

A slide plate 20*a* is disposed at a lower side of the playing surface 2*a* for sliding in a horizontal direction. An actuator knob 4*a* projects outwardly through a slot 2*d* provided in the playing surface 2*a*. The knob 4*a* further extends through a slot in the transparent plate 3*a* and is slidable in a recessed area formed on the transparent plate 3*a*. A striking member 9*a* is formed at one end of the slide plate 20*a and* projects through a hole provided in the playing surface 2*a*. The striking member 9*a* is disposed at a bottom portion of the playing surface 2*a*, which is defined by the area circumscribed by the elliptically shaped partition wall 5*a*.

For playing surface 2*a*, tension spring 21 has one end connected to the slide plate 20*a* and the other end connected to the transparent plate 3*a*. By moving the knob 4*a* to the right, a spring force is developed. When the knob 4a is released, the spring force propels the striking member 9*a* into the playing piece 10, thus shooting the playing piece 10 towards the outlet 11*a* (as guided by the partition plate 5*a*). The outlet 11*a* leads to a passage 6 which delivers the playing piece 10 to the next playing surface 2*b* shown as the middle playing surface in FIGS. 3 and 4.

To play a game on the top playing surface 2*a*, playing piece 10 is fed through an inlet 6*a* to the playing surface 2*a* and falls through a part of the passageway 6 by gravity to the bottom of the playing surface 2*a* where it becomes positioned next to the striking member 9*a*. The actuator knob 4*a* is moved from left to right as shown in FIG. 4. When released, the spring force generated by the tension spring 21 propels the striking member 9*a* into contact with the playing piece 10, which is guided by the curved partition plate 5*a* into the vicinity of the pins 19. The goal is to "shoot" the playing piece 10 with a force sufficient to cause the playing piece 10 to drop into the outlet 11a after dropping between the pins 19.

After dropping through the outlet 11, the playing piece 10 is led by the passage 6 and into an inlet 6*b* of the next playing surface 2*b*, illustrated as the middle playing surface in FIG. 3 and 4. The inlet 6*b* of the middle playing surface 2*b* leads the playing piece 10 through passage 6 to a lower portion of the playing surface. The partition wall 5*b*, which consists of a plurality of wall segments, defines the playing surface 2*b* and the outlet 11*b*. Initially, the playing piece 10 becomes lodged on an arcuate portion 8 of a wall segment of the partition wall 5*b*. The arcuate portion 8 is provided in three different locations of the playing surface 2*b*. A striking member 9*b* is disposed in a complementary relation with each arcuate portion 8 to hold the playing piece 10 at the three different locations. The outlet 11*b* is provided on the right-hand side of the playing surface 2*b* and leads the playing piece 10 through the passage 6 to the next playing surface 2*c*.

An actuator knob 4*b* projects outwardly through a slot 2*e* formed in the playing surface 2*b* at a lower right-hand portion thereof. The knob 4*b* also projects through the transparent plate 3*b* and is slidably disposed on a recessed area of the transparent plate 3*b*.

Openings 7*b* are provided in the playing surface 2*b* and are out of alignment with each other. The arcuate portions 8 of the partition wall 5*b* are disposed on one side of the openings 7*b*. The striking members 9*b* are located within the opening 7*b* and undergo translatory, reciprocating movement therein as a result of downward movement of the actuator knob 4*b*.

As shown in FIG. 3, the reverse-side of playing surface 2*b* has a lever 17 integrally formed with the actuator knob 4*b* which moves about pivot pin 13. A second lever 12 is connected to the first lever 17 and pivots about pivot pin 16, which functions as a fulcrum similar to pivot pin 13. A tension spring 18 is disposed between the first lever 17 and the second lever 12 to cause the actuator knob 4*b* to return to its upper-most position. The opposite ends of the tension spring 18 are connected to pins 14 and 15.

A pin 10*a* is formed on an upstanding portion of the lever 17. The pin 10*a* is received in a slot 12*a* formed in a distal end portion of the second lever 12. The middle striking member 9*b* is formed by an end of the upstanding portion of lever 17.

For playing surface 2*b*, the playing piece 10 is at first positioned at the lower striking member 9*b*. By moving the actuator knob 4*b* downwardly, the striking member 9*b* propels the playing piece 10 upwardly towards the middle striking member 9*b*. If the playing piece 10 lands on the middle striking member 9*b*, it is then propelled towards the upper striking member 9*b* by the same downward movement of the actuator knob 4*b*. The upper striking member 9*b*, which constitutes an end of an upstanding portion of the second lever 12, propels the playing piece 10 towards the outlet 11*b* shown on the right-hand side of playing surface 2*b*. The pin 10*a* projecting outwardly from the upstanding portion of the lever 17 engages the slot 12*a* of the second lever 12 so as to move the second lever 12 pivotally about the pivot pin 16. Thus, the upper-most striking member 9*b* is forced to strike the playing piece 10 and propel it towards the outlet 11*b*, whereupon the playing piece 10 is led by gravity through the passage 6 to an inlet 6*c* of the next playing surface 2*c*.

For playing surface 2*c*, an outlet 11*c* is defined by a partition wall 5*c*, which includes a plurality of wall segments. The outlet 11*c* is normally closed by a pivotal gate member 22.

A striking member 9*c* and the pivotal gate member 22 are linked for synchronized movement. The pivotal gate member 22 moves upwardly to uncover the outlet 11*c* when the striking member 9*c* moves to propel the playing piece 10. The striking member 9*c* is movable in an arcuate opening 7*c*. An actuator knob 4*c* extends through a slot 2*f* provided in the playing surface 2*c*, and through a slot provided in the transparent plate 3*c*. The knob 4*c* is slidable over a recessed portion of the transparent plate 3*c*. Downward movement of the actuator knob 4*c* causes the striking member 9*c* to propel the playing piece 10 in the direction of the outlet 11*c*. Pivotal gate member 22 pivots just enough to expose an opening large enough for the playing piece 10 to pass through.

Referring to FIG. 3, a lever 25 is movably supported on pin 23 which serves as a fulcrum. The lever 25 moves in response to downward movement of the actuator knob 4c, which is returned to its upper-most position by a tension spring 39. The striking member 9c is integrally formed on a pivotal arm 27, the lower end of which is pivotally supported by pivot pin 27a. A slot 28 is formed in the pivotal arm 27 and receives a pin disposed on a distal end of the lever 25. When the actuator knob 4c is moved downwardly, the lever 25 pivots upwardly, thus causing the striking member 9c to move clockwise (relative to FIG. 4). The striking member 9c thus strikes the playing piece 10 and propels the same towards the outlet 11c.

A lever 26 is pivotally connected to the lever 25 at an end thereof next to the actuator knob 4c. A link 29 is pivotally connected to a distal end of the lever 26 through a pin 29b. The distal end of the link 29 is pivotally connected to a support shaft 29a which supports the proximal end of the pivotal gate member 22. Thus, when the actuator knob 4c is moved downwardly, the pivotal gate member 22 pivots on the support shaft 29a in a clockwise direction (referring to FIG. 4) so as to uncover the outlet 11c and allow the playing piece 10 to pass therethrough.

The outlet 11c of playing surface 2c leads to the passage 6 which returns the playing piece 10 to the top playing surface 2a shown in FIGS. 3 and 4. Thus, for each of the three playing surfaces 2, each outlet of one playing surface is in communication with an inlet of the next successive playing surface so that a playing piece, or preferably playing pieces, continually pass from one playing surface to the next adjacent one successively. Each game played on each surface is different.

A variety of patterns can be formed on the playing surfaces 2. The outlets for each playing surface are interconnected to the next adjacent playing surface by a passage which extends from the outlet of one playing surface to the inlet of the next adjacent playing surface. Thus, when a plurality of playing pieces are contained on one playing surface, a player continues to play on the playing surface until all of the playing pieces have been propelled through the outlet thereof, whereupon the trihedron is rotated so that the next playing surface faces the player and the playing pieces are propelled towards the next playing surface.

The many features and advantages of the present invention are apparent from the detailed specification, and thus, it is intended by the appended claims to cover all such features and advantages of the board game which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to falling within the scope and the spirit of the invention.

What is claimed is:

1. A board game comprising:

a polyhedron-shaped member having a plurality of non-coplanar playing surfaces;

a transparent plate covering each playing surface;

at least one playing piece movable between the playing surfaces and the transparent plates;

an inlet and an outlet associated with each playing surface, with the inlet of one playing surface being in communication with the outlet of an adjacent playing surface; and actuator means, associated with each playing surface, for propelling the at least one playing piece towards the outlet of each corresponding playing surface.

2. A board game according to claim 1, further comprising a stand rotatably supporting the polyhedron-shaped member in a horizontal disposition.

3. A board game according to claim 2, wherein the stand includes two spaced apart vertical support arms pivotally supporting the polyhedron-shaped member therebetween, and a stop mechanism connected to one of the two vertical support arms at a lower, forward portion thereof for preventing the polyhedron-shaped member from rotating in one direction.

4. A board game according to claim 1, wherein each playing surface is flat and includes at least one partition wall which directs the at least one playing piece towards the outlet associated with each playing surface.

5. A board game according to claim 1, wherein the inlets and outlets of the plurality of playing surfaces are interconnected through a continuous passage.

6. A board game according to claim 1, wherein the polyhedron-shaped member is a trihedron having three playing surfaces.

7. A board game according to claim 6, wherein one of the playing surfaces is circumscribed by an elliptically-shaped partition wall and has the outlet disposed centrally below a plurality of pins, and the actuator means comprises a striking member disposed at a bottom portion of the playing surface.

8. A board game according to claim 6, wherein one of the playing surfaces includes at least one partition wall, a plurality of steps for holding the at least one playing piece at three vertically spaced apart levels, and the actuator means comprises a striking member associated with each step for propelling the at least one playing piece successively from a lower-most one of the steps to an upper-most one of the steps, and from the upper-most one of the steps to the outlet of the playing surface.

9. A board game according to claim 8, wherein the striking members are interconnected for synchronized movement.

10. A board game according to claim 6, wherein one of the playing surfaces includes a plurality of partition walls, a striking member disposed at a bottom portion of the playing surface and being movable in a direction of the outlet, and a pivotal gate member covering the outlet and being linked to the striking member for synchronized movement so as to uncover the outlet when the striking member moves to propel the at least one playing piece towards the outlet.

11. A board game according to claim 10, wherein the pivotal gate member is linked to a first lever which is pivotally connected to a second lever, and the second lever is operatively connected to the striking member so that downward movement of the second lever causes clockwise pivotal movement of the striking member and pivotal upward movement of the pivotal gate member.

12. A board game according to claim 6, wherein a first of the three playing surfaces is circumscribed by an elliptically-shaped partition wall and has the outlet disposed centrally below a plurality of pins, and a first striking member disposed at a bottom portion of the playing surface, and wherein a second of the three playing surfaces includes at least one partition wall, a plurality of steps for holding the at least one playing piece at three vertically spaced apart levels, and second, third and fourth striking members associated with the three steps for propelling the at least one playing piece successively from a lower-most one of the steps to an upper-most one of the steps, and from the upper-most one of the steps to the outlet of the second playing surface, and wherein a third of the three playing surfaces includes at least one partition wall, a fifth striking member disposed at a bottom portion of the playing surface and being movable in a direction of the outlet, and a pivotal gate member covering the outlet and being linked to the fifth striking member so as to uncover the outlet when the striking member moves to propel the at least one playing piece towards the outlet.

13. A board game according to claim 1, wherein each of the plurality of playing surfaces includes at least one partition wall upstanding from inner surfaces of the transparent plates.

14. A board game according to claim 1, wherein each transparent plate has an inner surface and includes a plurality of spacers which extend outwardly from inner surfaces of the transparent plates, and each playing surface is supported on the spacers.

15. A board game according to claim 14, wherein each of the plurality of playing surfaces includes at least one partition wall upstanding from inner surfaces of the transparent plates.

* * * * *